US006158838A

United States Patent [19]

Capurso

[11] Patent Number: 6,158,838

[45] Date of Patent: Dec. 12, 2000

[54] METHOD AND APPARATUS FOR CLEANING AND CAPPING A PRINT HEAD IN AN INK JET PRINTER

[75] Inventor: Robert G. Capurso, Bergin, N.Y.

[73] Assignee: Eastman Kodak Company, Rochester, N.Y.

[21] Appl. No.: 09/210,267

[22] Filed: Dec. 10, 1998

[51] Int. Cl.[7] ..... B41J 2/165

[52] U.S. Cl. ..... 347/28; 347/29; 347/33; 347/34

[58] Field of Search ..... 347/28, 21, 31, 347/29, 33, 34

[56] References Cited

U.S. PATENT DOCUMENTS

| | | | |
|---|---|---|---|
| 3,839,721 | 10/1974 | Chen et al. | 347/28 |
| 4,106,032 | 8/1978 | Miura et al. | 347/21 |
| 4,223,324 | 9/1980 | Yamamori et al. | 347/21 |
| 4,296,418 | 10/1981 | Yamazaki et al. | 347/28 |
| 4,301,460 | 11/1981 | Miura et al. | 347/21 |
| 4,358,781 | 11/1982 | Yamamori et al. | 347/21 |
| 4,417,259 | 11/1983 | Maeda | 347/31 |
| 4,959,662 | 9/1990 | Kobayashi | 347/28 |
| 5,495,272 | 2/1996 | Yamaguchi | 347/28 |
| 5,790,147 | 8/1998 | Hensel | 347/28 |
| 6,007,177 | 12/1999 | Takanaka et al. | 347/28 |

*Primary Examiner*—Thinh Nguyen
*Attorney, Agent, or Firm*—Thomas H. Close

[57] ABSTRACT

A cleaning and capping station for an ink jet print head having a nozzle plate forming a plurality of ink ejecting nozzles includes an elastomeric seal for forming an enclosure around the nozzles in the nozzle plate. A mist of fluid containing an ink solvent is sprayed into the enclosure onto the nozzle plate. Ink is ejected from the head onto an absorbent material, and the nozzle plate is wiped with an elastomeric wiper after ink is ejected from the print head.

5 Claims, 1 Drawing Sheet

METHOD AND APPARATUS FOR CLEANING AND CAPPING A PRINT HEAD IN AN INK JET PRINTER

FIELD OF THE INVENTION

The present invention relates to cleaning and capping an ink jet print head in an ink jet printer, and more particularly to such cleaning and capping wherein the ink jet nozzles in the print head are kept moist during capping by a fine mist containing an ink solvent.

BACKGROUND OF THE INVENTION

Ink jet print heads have a need for frequent cleaning and capping to avoid clogged nozzles. If the nozzles are not used frequently, ink in the nozzles will dry out and slowly build up until a clog occurs in the nozzle. Customarily manufacturers use a combination of spitting ink (periodically ejecting ink from the print head while in a cleaning station), suctioning ink from the head through the nozzles, and/or capping off of the nozzles to prevent clogs and nozzle dry-up. These measures are often not successful and hardening of ink in the nozzles after a long delay between printing times results in clogged non-functioning nozzles.

It is known to add a moistening device in the print head to keep the nozzle plate moist and thereby prevent ink from drying. For example, see U.S. Pat. No. 4,417,259, issued Nov. 22, 1983, to Maeda, which uses an air cell in the front of the print head that is filled with air during printing, but is filled with a liquid when the inkjet print head is not printing. Another approach to cleaning an ink jet print head in an ink jet printer is to intermittently suck a cleaning solution into the ink jet print head through the nozzles and discharge the solution therefrom, thereby removing hardened ink from nozzles. For example, see U.S. Pat. No. 5,495,272, issued Feb. 27, 1996, to Yamaguchi. It is also known to provide a vapor chamber for enclosing the ink jet nozzles during shutdown periods to prevent ink from drying at the nozzles. See U.S. Pat. No. 3,839,721, issued Oct. 1, 1974, to Chen et al. Many of these prior art systems involve additional cost and complexity of extra tubing and check valves to perform this task, and none have proven to be entirely satisfactory.

It is also known to provide a steam cleaning device that is used to clean the nozzles of ink jet print heads that are being recycled. See U.S. Pat. No. 5,790,147, issued Aug. 4, 1998, to Hensel. However, it is not considered to be practical or safe to employ live steam in an ink jet printer. There is a need therefore for an improved method of cleaning and capping an ink jet print head in an ink jet printer.

SUMMARY OF THE INVENTION

The need is met according to the present invention by providing a cleaning and capping station for an ink jet print head having a nozzle plate forming a plurality of ink ejecting nozzles. The cleaning and capping station includes an elastomeric seal for forming an enclosure around the nozzles in the nozzle plate. A mist of fluid containing an ink solvent is sprayed into the enclosure onto the nozzle plate. Ink is ejected from the head onto an absorbent material, and the nozzle plate is wiped with an elastomeric wiper after ink is ejected from the print head. In a preferred embodiment of the invention, the absorbent material is located in the enclosure formed by the elastomeric seal, and the elastomeric wiper is integrally formed with the elastomeric seal.

ADVANTAGES

The advantages of the present invention are that the ink present at the nozzle orifice remains moist as well as diluted to prevent ink coagulation and avoid clogging and ink build-up which is a big factor in ink jet head failure and/or printing delays. Further, this invention utilizes a minimal amount of space to perform capping, spitting, and cleaning of an ink jet print head.

DETAILED DESCRIPTION OF THE INVENTION

Figure 1:
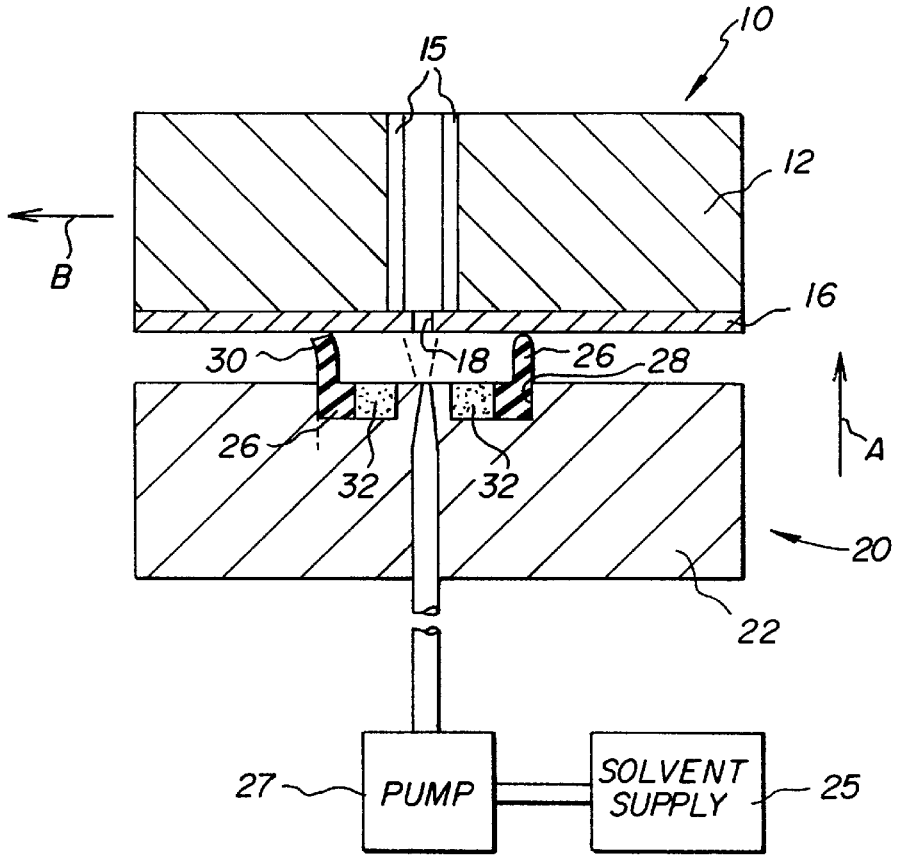
FIG. 1 is a cross-sectional view of a combined capping and cleaning station, according to a preferred embodiment of the present invention.

Referring to FIG. 1, a partial cross-sectional view of an ink jet print head 10 is shown. Since ink jet print heads and their operation in an ink jet printer are well known in the art, only the features of the prior art print heads and ink jet printers as they relate to the present invention, will be described herein. The print head 10 includes a print head body 12 defining an ink channel 14 and a piezoelectric actuator 15 for expelling ink from the channel 14. The ink channel 14 is covered with a nozzle plate 16 that defines a row of ink jet nozzles 18 (only one of which is shown in the Figure) from which ink is ejected for printing. The piezoelectric ink jet print head 10 is shown by way of example, as it will be understood that other different types of drop-on-demand ink jet print heads, such as bubble jet print heads, can be employed with the present invention.

Opposite the print head 10 is a cleaning/capping station generally designated 20, according to a preferred embodiment of the present invention. The cleaning/capping station 20 includes a body 22 defining a mist nozzle 24 through which a solvent mist is periodically sprayed onto the ink jet nozzle plate 16. Depending on the length of the print head 10, a row of mist nozzles 24, extending in the same direction as the row of ink jet nozzles 18 in the print head 10, may be provided. The solvent is supplied to the mist nozzle 24 from a solvent supply container 25, under high pressure, by a pump 27. Pump 27 is for example a solenoid actuated pump of the type used in fuel injection systems. The pump 27 is actuated periodically to direct a fine mist of solvent onto the face of the nozzle plate 16. If the ink is a water based ink, a suitable solvent would be water, or water mixed with water miscible solvents such as polyhydric alcohols. Such solvents can be used with dye or pigment inks. The frequency of the misting is selected depending on the ink type used (dye or pigment) to provide sufficient moisture so that the ink jet nozzles 18 do not become clogged.

An elastomeric rubber seal 26 is mounted in a recess 28 in the body 22. The elastomeric seal (composed, for example of butyl rubber) is configured to completely surround the ink jet nozzle(s) 18 when the print head is positioned with respect to the cleaning/capping station 20. The cleaning/capping station 20 is moved in the direction of arrow A as shown in FIG. 1, until the seal 26 is pressed against the nozzle plate 16 of the print head 10. The seal 26 seals against the nozzle plate 16 to shield the ink jet nozzle(s) 18 from outside air, thereby, in cooperation with the solvent mist, preventing ink from drying in and clogging the ink jet nozzle(s) 18.

One wall 30 of the seal 26 acts as a wiper of the nozzle plate 16 as will be described below. A pad 32 of absorbent material, such as fibrous polyester, surrounds the solvent mist nozzle(s) 24 and is used to absorb ink when spitting is performed prior to wiping and printing.

In addition to periodically spraying the solvent mist, spitting and cleaning operations are accomplished by moving the printing head 10 a short distance in the direction of arrow B, until the ink jet nozzle(s) 18 are positioned over the absorbent pad 32 and energizing the ink jet print head 10 to spit ink from all of the ink jet nozzle(s) 18. The ink jet print head is then further moved in the direction of arrow B so that the wiper blade 30 wipes away any solvent-diluted ink remaining on the nozzle plate 16 of the print head 10.

Since space is often a premium in printers, there may be an incentive to keep the cleaning/capping station as small as possible. Therefore according to the preferred mode of practicing the invention, as described above, the cleaning/capping station 20 involves a single unitary construction. This combined cleaning/capping station allows for the head to be moved slightly in the direction of Arrow B toward the one wall 30 of the seal 26 that also functions as a wiping blade and perform a spitting operation into the absorbent pad 32. The print head 10 is then moved across the wiping blade 30. Once the cleaning operation is complete, the capping cleaning station 20 is moved down opposite the direction of arrow A, and the print head 10 is then moved on to begin the normal printing operation.

Figure 2:
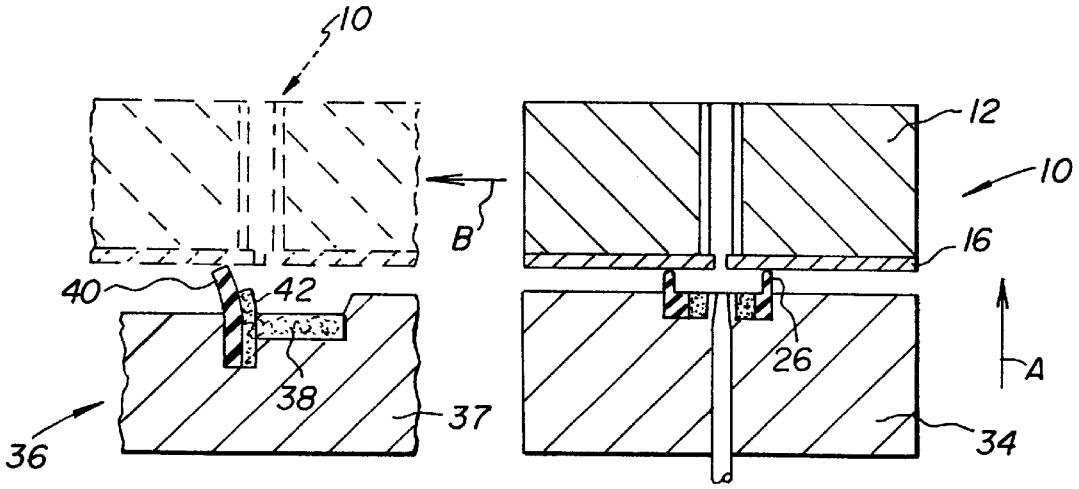
FIG. 2 is a cross-sectional view of separate capping and cleaning stations according to an alternative embodiment of the present invention.

Referring to FIG. 2, according to an alternative embodiment of the present invention, the cleaning and capping stations are separate units. The capping station 34 is similar to the cleaning/capping station 20 shown in FIG. 1, with the exception that one of the walls of the elastomeric seal 26 does not form a wiping blade. A spitting/cleaning station 36 is provided adjacent to the capping station 34.

The spitting/cleaning station 36 includes a body 37 having a recess containing a pad of absorbent material 38 for receiving the ink that is spit from the print head 10, and an elastomeric wiping blade 40 for wiping the ink and solvent from the face of the nozzle plate 16. Elastomeric wiping blade 40 is backed by a strip of absorbent material 42.

In operation, the print head 10 is moved to the capping station 34 and the capping station is raised in the direction of arrow A until the seal 26 contacts the nozzle plate 16. A mist of solvent is then periodically sprayed onto the nozzle plate 16 of the print head 10. Before printing, the capping station is lowered in the direction opposite to arrow A, and the print head 10 is moved in the direction of arrow B to the spitting cleaning station 36, as shown by the dotted lines in FIG. 2. The print head 10 is moved in the direction of arrow B until the ink jet nozzles are directly over the absorbent pad 38. The print head is then actuated to spit ink from all of the nozzles. The print head 10 is then moved further in the direction of arrow B to cause the wiping blade 40 to wipe the solvent diluted ink from the face of the nozzle plate 16.

The invention has been described in detail with particular reference to certain preferred embodiments thereof, but it will be understood that variations and modifications can be effected within the spirit and scope of the invention.

PARTS LIST

10 ink jet print head
12 print head body
14 ink channel
15 piezoelectric actuator
16 nozzle plate
18 ink jet nozzle
20 cleaning /capping station
22 body
24 mist nozzle
25 solvent supply
26 elastomeric seal
27 pump
28 recess in body 22
30 wall of seal 26
32 absorbent pad
34 capping station
36 spitting/cleaning station
37 body of spitting/cleaning station
38 pad of absorbent material
40 elastomeric wiping blade
42 strip of absorbent material

What is claimed is:

1. A cleaning and capping station for an ink jet print head having a nozzle plate forming a plurality of ink ejecting nozzles, comprising:

a) an elastomeric seal positioned for forming an enclosure around the nozzles in the nozzle plate;

b) a source of fluid containing an ink solvent;

c) means connected to the source of fluid for spraying a mist of the fluid into the enclosure onto the nozzle plate;

d) an absorbent material located with respect to the printhead for receiving ink ejected from the print head; and e) an elastomeric wiper located with respect to the printhead for wiping the nozzle plate of the print head after ink is ejected from the print head.

2. The cleaning and capping station claimed in claim 1, wherein the absorbent material is located in the enclosure formed by the elastomeric seal.

3. The cleaning and capping station claimed in claim 2 wherein the elastomeric wiper is integrally formed with the elastomeric seal.

4. The cleaning and capping station claimed in claim 1, wherein the absorbent material and the elastomeric wiper are located outside of the enclosure formed by the elastomeric seal.

5. A method of cleaning and capping an ink jet print head having a nozzle plate forming a plurality of ink ejecting nozzles, comprising the steps of:

a) capping the nozzle plate with an elastomeric seal to form an enclosure;

b) spraying a mist of liquid containing an ink solvent onto the nozzle plate in the enclosure;

c) ejecting ink from the print head onto an absorbent material; and d) wiping the nozzle plate with an elastomeric wiper.

* * * * *